US007497634B2

(12) United States Patent
Kohira

(10) Patent No.: US 7,497,634 B2
(45) Date of Patent: Mar. 3, 2009

(54) MECHANISM FOR TEMPORARILY STOCKING RECORDING SHEET MATERIAL AND PRINTER EQUIPPED WITH THE SAME

(75) Inventor: Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 475 days.

(21) Appl. No.: 11/226,584

(22) Filed: Sep. 14, 2005

(65) Prior Publication Data

US 2006/0062627 A1 Mar. 23, 2006

(30) Foreign Application Priority Data

Sep. 17, 2004 (JP) ..... 2004-271265

(51) Int. Cl.
*B41J 3/60* (2006.01)
*B65H 29/58* (2006.01)

(52) U.S. Cl. ..... 400/642; 400/621; 347/218

(58) Field of Classification Search ..... 400/621, 400/614, 642, 643; 347/215, 218; 271/225
See application file for complete search history.

(56) References Cited

U.S. PATENT DOCUMENTS 4,962,386 A * 10/1990 Hakkaku et al. ..... 347/232
2003/0189631 A1* 10/2003 Hoshino et al. ..... 347/218

FOREIGN PATENT DOCUMENTS

| | | | |
|---|---|---|---|
| DE | 4417770 | | 11/1995 |
| JP | 00063022 | | 2/2000 |
| JP | 2000296630 A | * | 10/2000 |
| JP | 2004216732 A | * | 8/2004 |

OTHER PUBLICATIONS

Translation of the Abstract for Japan Patent No. 2004-216732 A.*
Translation of the Detailed Description for Japan Patent No. 2004-216732 A.*
Translation of the Abstract for Japan Patent No. 2000-296630 A.*
Translation of the Detailed Description for Japan Patent No. 2000-296630 A.*

* cited by examiner

*Primary Examiner*—Leslie J Evanisko
(74) *Attorney, Agent, or Firm*—Adams & Wilks

(57) ABSTRACT

Disclosed are a sheet material stocking mechanism providing a large stocking capacity with a small space and a printer equipped with such a stocking mechanism. A thermal printer is composed of a roll accommodating unit (2) retaining a heat sensitive adhesive sheet (1) wound into a roll, a printing unit including a printing thermal head (4) for performing printing on the heat sensitive adhesive sheet (1), a cutter unit (3) for cutting the heat sensitive adhesive sheet (1), a stocking unit including a take-up device (10) which takes up the heat sensitive adhesive sheet (1) that has undergone printing in a cylindrical form to stock it temporarily, and a thermal activation unit including a thermal activation thermal head (6) that thermally activates a heat sensitive adhesive agent layer of the heat sensitive adhesive sheet (1).

18 Claims, 5 Drawing Sheets

MECHANISM FOR TEMPORARILY STOCKING RECORDING SHEET MATERIAL AND PRINTER EQUIPPED WITH THE SAME

BACKGROUND OF THE INVENTION

1. Field of the Invention

The present invention relates to a printer that performs recording on a sheet material, in particular, a mechanism for temporarily stocking a sheet material that has undergone recording. The sheet materials to which the present invention is applicable include, apart from an ordinary sheet material such as a paper sheet which allows recording on one side or both sides thereof, a sheet material having a thermal activation adhesive surface which develops an adhesion property by being heated on the back side of the recording surface (printing surface), and a sheet material having on the back side of the recording surface an adhesive surface with a release sheet (liner) attached thereto.

2. Description of the Related Art

Conventionally, as disclosed in JP 2003-316265 A, there has been available an apparatus which, after recording on a sheet material serving as a recording material, temporarily stocks the sheet material for the purpose of cutting the sheet material in a predetermined length.

The apparatus disclosed in JP 2003-316265 A is a printer applicable to a sheet material having a recording surface on which recording, such as printing, is effected, and a thermal activation surface which develops an adhesion property by being heated on the back side of the recording surface.

This printer is equipped with a printing apparatus, a cutter device, and a thermal activation apparatus. The printing apparatus has a printing means for performing printing on a recording surface of a sheet material, and a first conveying means for conveying the sheet material in a predetermined direction. The cutter device is provided on the output side of the printing apparatus, and the thermal activation apparatus is provided on the output side of the cutter device. The thermal activation apparatus has a heating means for heating the side of the sheet material reverse to the recording surface, and a second conveying means for conveying the sheet material in a predetermined direction. Between the cutter device and the thermal activation apparatus, there is provided a space portion capable of deflecting the sheet by a predetermined length.

In this printer, constructed as described above, printing is performed on the recording surface of the sheet material while conveying the sheet material by the first conveying means, and then the thermal activation adhesive surface on the side of the sheet material reverse to the recording surface is heated while conveying the sheet material by the second conveying means.

In this process, the conveying speed of the second conveying means is set higher than the conveying speed of the first conveying means, whereby the sheet material is deflected in the space portion between the cutter device and the thermal activation apparatus. When the sheet material has been deflected by a predetermined length, the operation of the printing means and the first conveying means is stopped while continuing the operation of the heating means and the second conveying means, and the sheet material is cut by the cutter device.

While in the apparatus disclosed in JP 2003-316265A the sheet material is temporarily stocked by deflecting it into a U-shape, there is another known method according to which the sheet material is stocked by deflecting it into a bellows-like fashion.

As another conventional apparatus equipped with a mechanism for temporarily stocking a recording sheet, there exists a printer as disclosed in JP 2001-261228A. In the printer as disclosed in the above-mentioned publication, when the leading end of the sheet material undergoing printing sticks out of the discharge port of the apparatus casing, the sheet material is pulled or pressurized to cause recording drift, jamming, etc. before the completion of the recording or sheet cutting operation. To prevent such an inconvenience, the sheet material is stocked inside the apparatus until the recording and sheet cutting operations have been completed, the sheet material being discharged to the exterior of the apparatus through a discharge port after the completion of these operations.

This apparatus is equipped with a space in which the sheet that has undergone recording is kept dangling by its own weight while held by a driving roller and a driven roller. The sheet that has undergone recording is temporarily stocked in this space, and when the recording and sheet cutting have been completed, the driving roller is driven in a reverse rotation to switch the sheet conveying direction, and the sheet that has undergone recording and cutting is discharged to the exterior of the apparatus through the discharge port.

The mechanism for temporarily stocking the recording material as disclosed in JP 2003-316265A and JP 2001-261228A adopts a system in which the sheet material that has undergone recording is deflected into a U-shape or in a bellows-like fashion or kept dangling in a predetermined space until a predetermined processing, such as recording or sheet cutting, has been completed.

Thus, the mechanism has a problem in that the larger the length of one sheet required during the process from recording the sheet material to the cutting thereof, the larger the space that must be prepared for the stocking of the sheet material. In other words, depending on the size of the sheet material stocking space, the length of one sheet allowing recording is restricted.

Further, when the size of the space for stocking the sheet material is increased, the size of the apparatus main body becomes rather large. Thus, the temporary stocking mechanism as disclosed in JP 2003-316265 A and JP 2001-261228 A cannot be applied to a small-size mobile printer that can be easily carried about with one hand.

SUMMARY OF THE INVENTION

In view of the above problem in the prior art, it is an object of the present invention to provide a temporary stocking mechanism for a sheet-like recording material providing a large stocking capacity with a small space, and a printer equipped with such a temporary stocking mechanism.

To achieve the above object, in accordance with the present invention, there is provided a temporary stocking mechanism for a recording material which temporarily stocks a sheet-like recording material before executing a predetermined processing thereon, characterized by including a take-up device which takes up the sheet-like recording material on a roller for the purpose of stocking it. The present invention also covers a printer equipped with such a temporary stocking mechanism.

In the above construction, when temporarily stocking the sheet-like recording material, the sheet-like recording material is stocked in a state in which it has been taken up on the roller. Thus, unlike the conventional construction in which the sheet-like recording material is stocked while deflected into a U-shape or in a bellows-like fashion or kept dangling, this construction does not require the preparation of a large stocking space. In other words, it is possible to stock a relatively long recording material in a small stocking space.

As described above, according to the present invention, the sheet-like recording material is stocked in a state in which it has been taken up on the roller, so that there is no need to prepare a large space for stocking the sheet-like recording material, thereby achieving a reduction in apparatus size. Further, since the sheet-like recording material is wound around the roller, the sheet length allowing stocking is less restricted.

Further, the temporary stocking mechanism of the present invention provides a large stocking capacity with a small space, so that it is also applicable to a small-size mobile printer.

DETAILED DESCRIPTION OF THE PREFERRED EMBODIMENT

An embodiment of the present invention will now be described with reference to the drawings.

Figure 1:
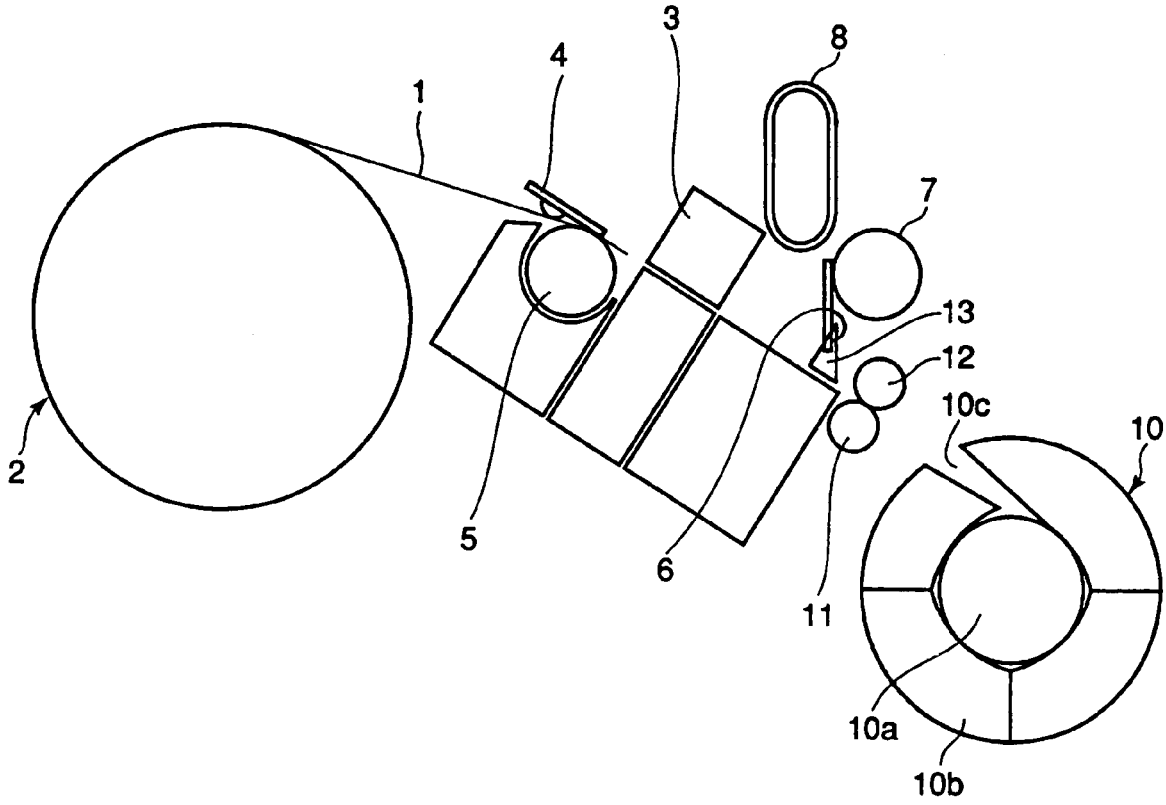
FIG. 1 is a schematic diagram showing the construction of a thermal printer according to an embodiment of the present invention.

FIG. 1 is a schematic diagram showing the construction of a thermal printer according to an embodiment of the present invention.

The thermal printer as shown in FIG. 1 has a roll accommodating unit 2 retaining a tape-like heat sensitive adhesive sheet 1, a printing unit including a printing thermal head 4 for performing printing on the heat sensitive adhesive sheet 1, a cutter unit 3 for cutting the heat sensitive adhesive unit 1, a stocking unit including a take-up device 10 for taking up the heat sensitive adhesive sheet 1 that has undergone printing on a take up roller device 10*a* to temporarily stock it, and a thermal activation unit including a thermal activation head 6 for thermally activating the heat sensitive adhesive agent layer of the heat sensitive adhesive sheet 1. Further, this printer is equipped with a conveying direction switching means 13 for switching between the direction in which the heat sensitive adhesive sheet 1 that has undergone printing by the printing thermal head 4 and passed through the cutter unit 3 is conveyed into the take-up device 10, and the direction in which the heat sensitive adhesive sheet is conveyed from within the take-up device 10 toward the thermal activation thermal head 6 of the thermal activation unit. In this specification, the term "printing" includes the image formation of not only characters and figures but also of pictures, patterns, etc.

The heat sensitive adhesive sheet 1 has a construction in which a heat insulating layer and a heat sensitive coloring layer (layer allowing printing; hereinafter also referred to as the "printable layer") are formed, for example, on the obverse side of a sheet base material, and in which a heat sensitive adhesive agent is applied to and dried on the reverse side of the sheet material to form a heat sensitive adhesive agent layer. The heat sensitive adhesive agent layer consists of a heat sensitive adhesive agent whose main component is a thermoplastic resin, a solid plastic resin, or the like. Further, the heat sensitive adhesive sheet 1 may also be one having no heat insulating layer or one having on the surface of the heat sensitive layer a protective layer or a colored printed layer (a layer that has previously undergone printing).

The printing thermal head 4 of the printing unit has a plurality of heat generating elements consisting of a plurality of relatively small resistors arranged in the width direction so as to allow dot printing. The printing unit is equipped with a printing platen roller 5 held in press contact with the printing thermal head 4.

Further, the above printing unit is equipped with a drive system (not shown) adapted to rotate the printing platen roller 5 and composed, for example, of a stepping motor and a gear row or the like; by rotating the printing platen roller 5 in a predetermined direction by this drive system, the heat sensitive adhesive sheet 1 attached to the roll accommodating unit 2 is pulled out of the roll, and sent out in a predetermined direction while undergoing printing by the printing thermal head 4. In FIG. 1, the printing platen roller 5 is rotated clockwise, and the heat sensitive adhesive sheet 1 is conveyed obliquely downward to the right as seen in the drawing. Further, the above printing unit is equipped with a pressurizing means (not shown) consisting of a coil spring, a plate spring, or the like, and, by the elastic force of this pressurizing means, the printing plate roller 5 is pressed against the printing thermal head 4. At this time, the axial direction of the rotation shaft of the printing platen roller 5 and the heat generating element arranging direction in the printing thermal head 4 are kept parallel to each other, whereby press contact can be effected uniformly over the entire range in the width direction of the heat sensitive adhesive sheet 1.

The cutter unit 3 serves to cut the heat sensitive adhesive sheet 1 that has undergone printing by the printing thermal head 4 in a predetermined length, and is composed of a movable cutting edge (not shown) operated by a drive source (not shown), such as an electric motor, a stationary cutting edge (not shown) opposed to the movable cutting edge, etc.

The take-up device 10 of the above stocking unit is equipped with the take-up roller 10*a* for taking up in a cylindrical fashion the heat sensitive adhesive sheet that has undergone printing and been conveyed, and a plurality of guides 10*b* arranged so as to surround the outer peripheral surface of the take-up roller 10*a*. The take-up roller 10*a* is controlled by using a rotary driving means, such as a motor. Further, the frictional resistance between the outer side surface of the take-up roller 10*a* and the heat sensitive adhesive sheet 1 is set higher than the frictional resistance between the heat sensitive adhesive sheet 1 and the guides 10*b*.

Figure 2:
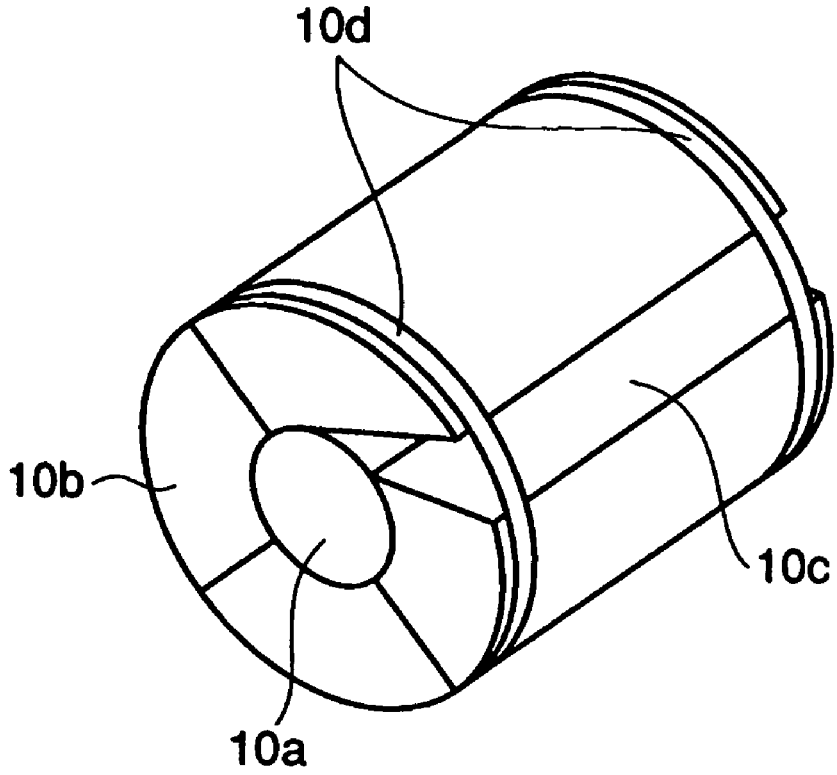
FIGS. 2A and 2B are diagrams showing an example of the construction of an urging means used in a take-up device shown in FIG. 1.
Figure 2:
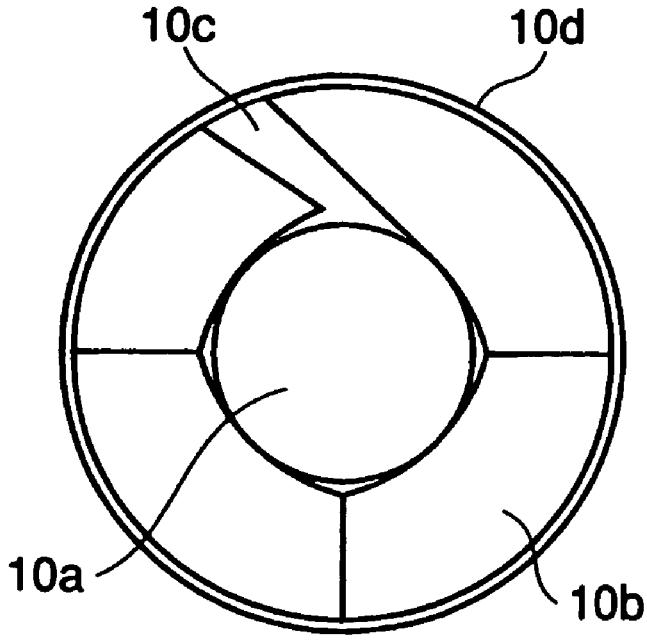
Figure 3:
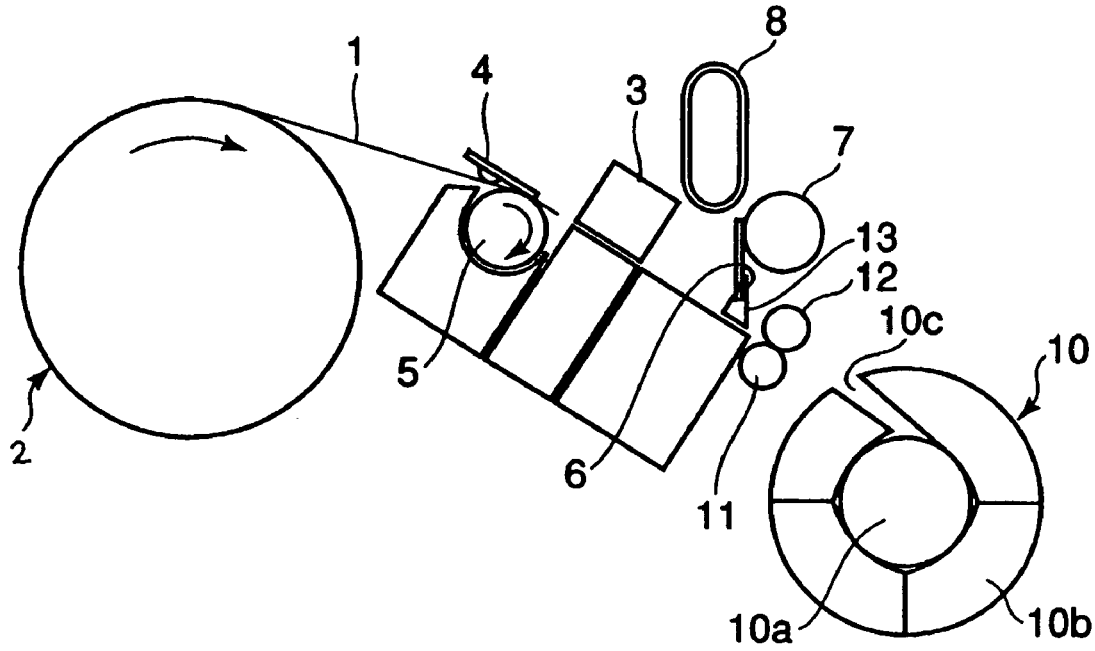
FIGS. 3A and 3B are schematic diagrams illustrating the operation of the thermal printer of FIG. 1.
Figure 3:
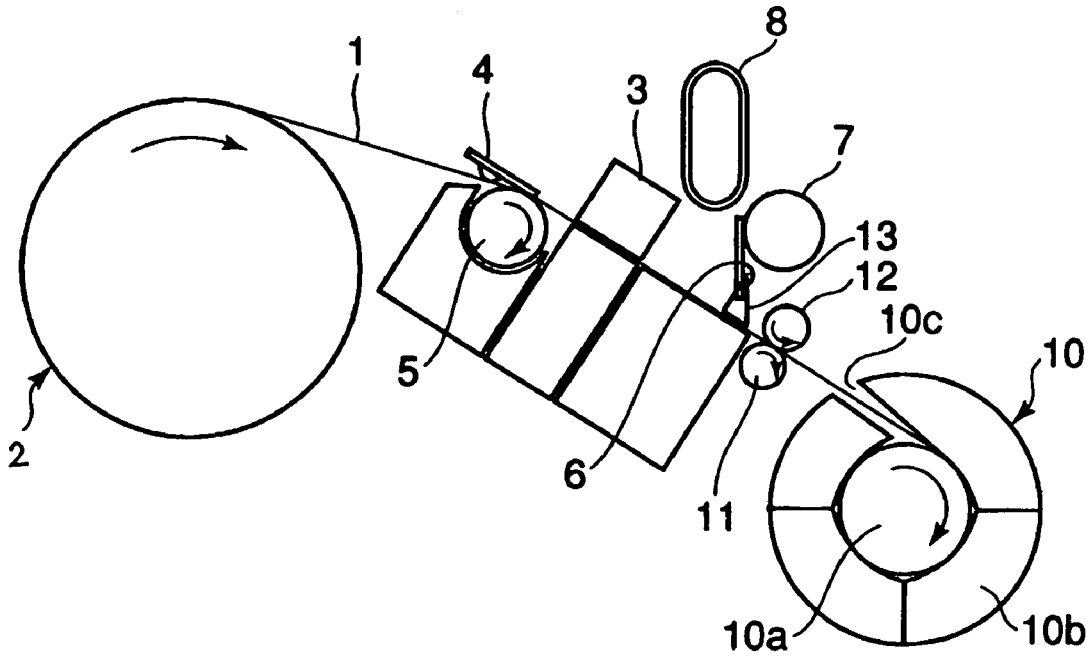

The guides 10*b* are mounted in a state in which they are urged against the outer peripheral surface of the take-up roller 10*a* by an elastic member. As a result, the guides 10*b* are held in close contact with the outer peripheral surface of the take-up roller 10*a*. When the pile thickness of the heat sensitive adhesive sheet 1 on the take-up roller 10*a* increases as the heat sensitive adhesive sheet 1 is taken up on the take-up roller 10*a*, the guides 10*b* move outwards in the radial direction of the take-up roller 10*a* by an amount corresponding to the thickness, thus enlarging the distance between the outer peripheral surface of the take-up roller 10*a* and the guides 10*b*. FIG. 2 shows an example of the construction for realizing this function. As shown in FIG. 2, two elastic members in the form of rubber bands 10*d* are wrapped in an annular fashion around the outer periphery formed by all guides 10*b* around the take-up roller 10*a*, whereby the guides 10*b* are mounted while urged against the outer peripheral surface of the take-up roller 10*a* by the rubber bands 10*d*. While in the example of FIG. 2 rubber bands are used, it is also possible to use, instead of rubber bands, a spring as long as it serves as a means for urging the guides 10*b* against the outer peripheral surface of the take-up roller 10*a*.

Further, the take-up device 10 is equipped with an insertion inlet 10*c* for inserting the heat sensitive adhesive sheet 1 into the gap between the outer peripheral surface of the take-up roller 10*a* and the guides 10*b*. Further, immediately before the insertion inlet 10*c*, there are arranged a conveying roller 11 for conveying the heat sensitive adhesive sheet 1 that has undergone printing, and a driven roller 12 adapted to be driven to rotate while pressurized by the conveying roller. While retaining the heat sensitive adhesive sheet 1 conveyed through the printing unit, the conveying roller 11 and the driven roller 12 introduce the heat sensitive adhesive sheet 1 into the insertion inlet 10*c* of the take-up device 10 or extract it out of the insertion inlet 10*c* of the take-up device 10. The switching between the introduction and extraction of the heat sensitive adhesive sheet 1 is effected by switching the rotating direction of the conveying roller 11. The conveying roller 11 is in synchronism with the rotating operation and rotating direction of the take-up roller 10*a*.

In this embodiment, the thermal activation thermal head 6 of the thermal activation unit described above is of a construction similar to that of the printing thermal head 4, that is, it is of a construction similar to that of the printing head of a well-known thermal printer, which is formed by providing a protective layer of crystallized glass on the surface of a plurality of heat generating resistors formed on a ceramic substrate by the thin-film technique. In this way, as the thermal activation thermal head 6, one of the same construction as the printing thermal head 4 is used, whereby it is possible to use the same component for different purposes, thereby achieving a reduction in cost. It should be noted, however, that it is not necessary for the heat generating element of the thermal activation thermal head 6 to be divided in dot units as in the case of the heat generating element of the printing thermal head 4; it may be a continuous resistor.

The above thermal activation unit is equipped with a thermal activation platen roller 7 held in press contact with the thermal activation thermal head 4, and a discharge roller 8 for discharging the thermally activated heat sensitive adhesive sheet 1 to the exterior of the apparatus casing.

Further, the thermal activation unit is equipped with a drive system adapted to rotate the thermal activation platen roller 7 and composed, for example, of a stepping motor and a gear row or the like; by this drive system, the thermal activation platen roller 7 is rotated clockwise, and the heat sensitive adhesive sheet 1 is conveyed upwards as seen in the drawing. Further, the thermal activation unit is equipped with a pressurizing means (e.g., a coil spring or a plate spring) for pressing the thermal activation platen roller 7 against the thermal activation thermal head 6. In this regard, by keeping the axial direction of the rotation shaft of the thermal activation platen roller 7 and the heat generating element arranging direction in the thermal activation thermal head 6 parallel to each other, it is possible to effect press contact uniformly over the entire range in the width direction of the heat sensitive adhesive sheet 1.

Next, the operation of the thermal printer of this embodiment will be described with reference to FIGS. 3A through 5B. FIGS. 3A through 5B are schematic diagrams illustrating the operation of the printer of FIG. 1.

First, the heat sensitive adhesive sheet 1 wound into a roll is attached to the roll accommodating unit 2. When, thereafter, the heat sensitive adhesive sheet 1 is conveyed to the printing unit, the printing platen roller 5 rotates, and printing control of the printing thermal head 4 is started. As shown in FIG. 3A, the heat sensitive adhesive sheet 1 is held between the printing platen roller 5 and the printing thermal head 4, and, as it is pulled out of the roll accommodating unit 2 through rotation of the printing platen roller 5, printing is performed on the printable layer (heat sensitive coloring layer) by the printing thermal head 4.

Then, the heat sensitive adhesive sheet 1 is delivered from the printing unit through rotation of the printing platen roller 5, and conveyed to the cutter unit 3 constituting the next stage.

After it has passed the cutter unit 3, the leading end of the heat sensitive adhesive sheet 1 is directed toward the stocking unit by the conveying direction switching means 13, and is caught between the conveying roller 11 and the driven roller 12 being rotated.

As shown in FIG. 3B, the heat sensitive adhesive sheet 1 is conveyed through rotation of the conveying roller 11 and the driven roller 12, and is inserted into the insertion inlet 10*c* of the take-up device 10. At this time, the take-up roller 10*a* rotates in the same direction as the conveying roller 11 in synchronism with the rotating operation of the conveying roller 11.

Figure 4A:
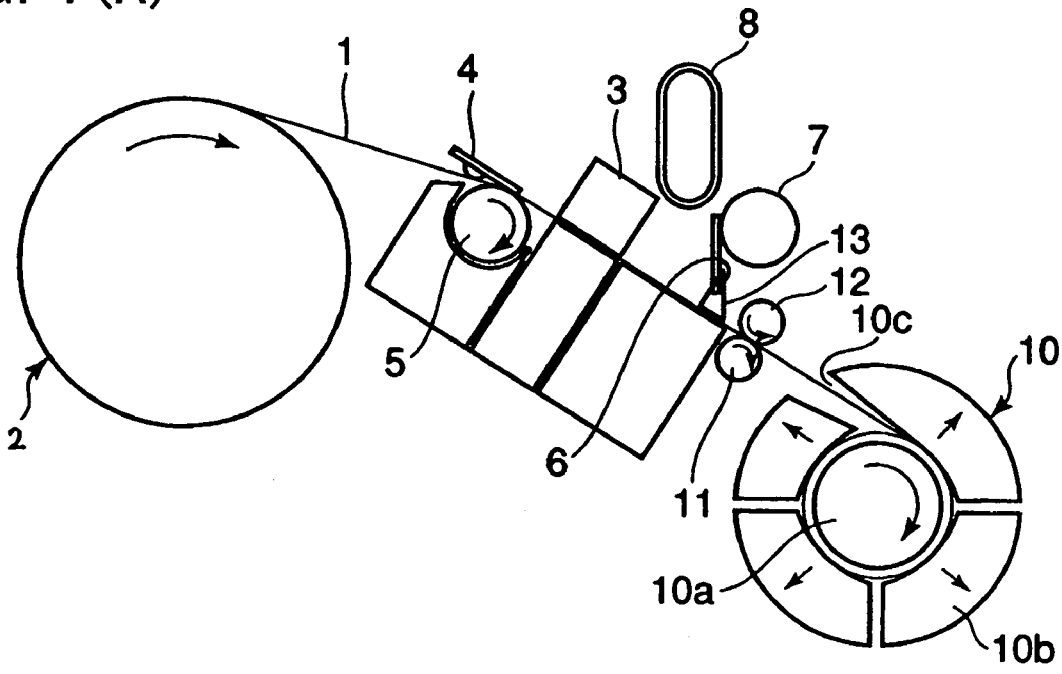
FIGS. 4A and 4B are schematic diagrams illustrating the operation of the thermal printer of FIG. 1.
Figure 4:
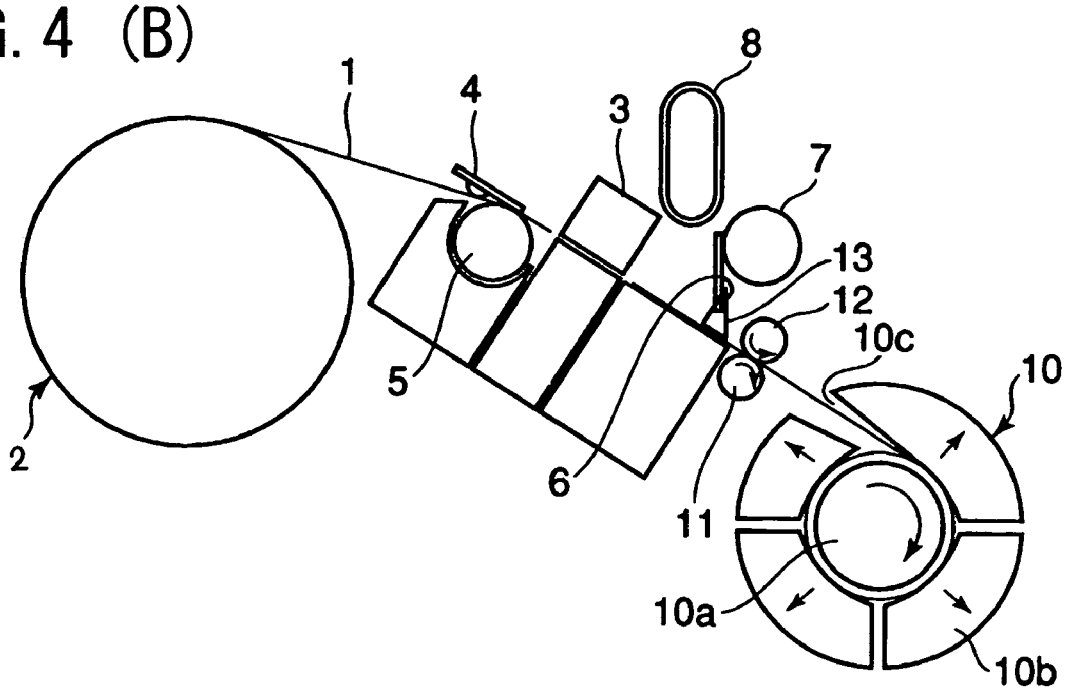
Figure 5:
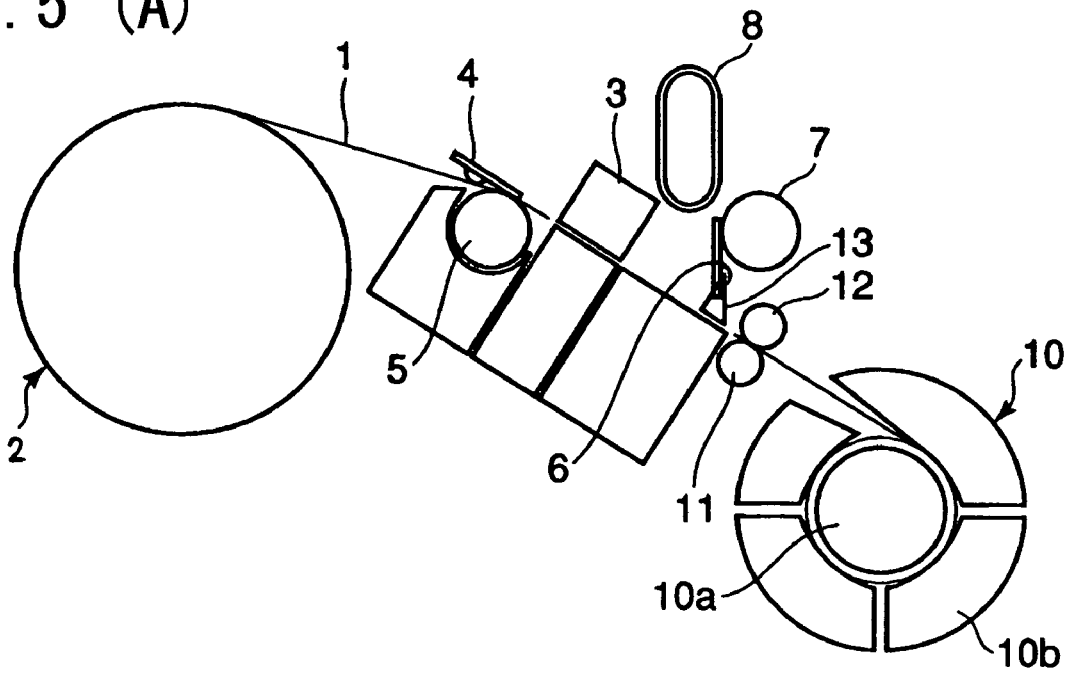
FIGS. 5A and 5B are schematic diagrams illustrating the operation of the thermal printer of FIG. 1.
Figure 5:
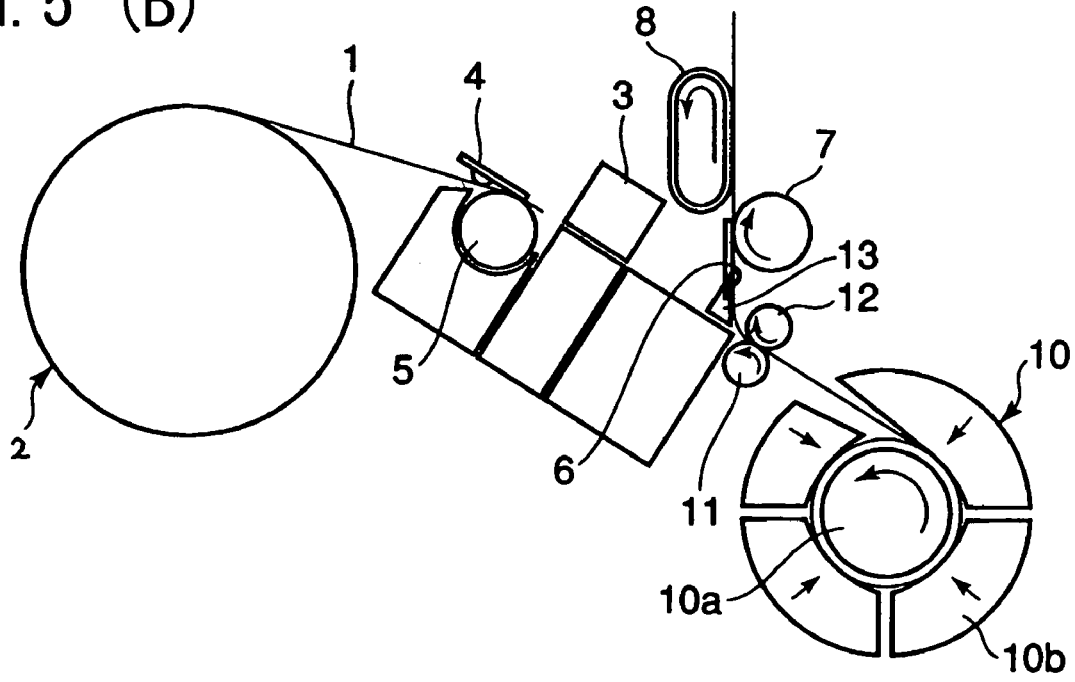

As it moves forward, the heat sensitive adhesive sheet 1 inserted into the insertion inlet 10*c* is gradually taken up on the take-up roller 10*a* of the take-up device 10. At this time, the guides 10*b* press the heat sensitive adhesive sheet 1 against the outer peripheral surface of the take-up roller 10*a* by the urging force of the elastic member, so that the heat sensitive adhesive sheet can be reliably wound around the take-up roller 10. As shown in FIG. 4A, as the heat sensitive adhesive sheet 1 is taken up on the take-up roller 10*a*, the pile thickness of the heat sensitive adhesive sheet 1 on the take-up roller 10*a* increases, and the guides 10*b* move outwardly in the radial direction of the take-up roller 10*a* by an amount corresponding to the thickness, with the result that the distance between the outer peripheral surface of the take-up roller 10*a* and the guides 10*b* increases.

When, thereafter, the printing operation by the printing thermal head 4 is completed, the rotating operation of the printing platen roller 5 and the conveying roller 11 is stopped, and the heat sensitive adhesive sheet 1 is cut at a desired position by the cutter unit 3.

After the cutting, the rotating operation of the conveying roller 11 is started again as shown in FIG. 4B, and the conveying roller 11 is driven until the trailing end of the heat sensitive adhesive sheet 1 that has been cut reaches the gap between the conveying roller 11 and the driven roller 12 as shown in FIG. 5A. At this time, the leading end portion of the heat sensitive adhesive sheet 1 that has been cut is further taken up on the take-up roller 10*a*.

Thereafter, as shown in FIG. 5B, the conveying roller 11 and the take-up roller 10*a* are reversed to rotate counterclockwise. As a result, the heat sensitive adhesive sheet 1 taken up by the take-up device 10 and temporarily stocked therein is pulled out of the take-up device 10 through the insertion inlet 10*c*. In this process, the conveying-direction of the heat sensitive adhesive sheet 1 temporarily stocked is switched to the thermal activation unit side by the conveying direction switching means 13.

When the heat sensitive adhesive sheet 1 temporarily stocked in the take-up device 10 of the stocking unit is conveyed to the thermal activation unit, the thermal activation platen roller 7 rotates clockwise, and heating control of the thermal activation thermal head 6 is started. At this time, the rotation control of the printing platen roller 5 remains interrupted.

The heat sensitive adhesive sheet 1 delivered from the take-up device 10 is caught between the thermal activation platen roller 7 and the thermal activation thermal head 6, and as it is conveyed through rotation of the thermal activation platen roller 7 and the conveying roller 11, the heat sensitive adhesive agent layer is heated by the thermal activation thermal head 6. At the time when this heating process is completed, the heat sensitive adhesive sheet 1 temporarily stocked in the take-up device 10 has been entirely pulled out, so that, as shown in FIG. 3B, the guides 10*b* of the take-up device 10 are restored to the state in which they are held in contact with the outer peripheral surface of the take-up roller 10*a* by the elastic member.

The heat sensitive adhesive sheet 1 of a predetermined length, which has undergone printing, cutting, and heating as described above, is discharged to the exterior of the apparatus through rotation of the discharge roller 8, and is attached as it is to a cardboard, a food wrapper, a glass bottle, a plastic container, etc. as an indicator label.

As described above in relation to the printer operation, the thermal printer of this embodiment adopts the take-up roller 10*a* as the mechanism for temporarily stocking the heat sensitive adhesive sheet 1 that has undergone printing prior to executing cutting and thermal activation processing, so that it is possible to stock the heat sensitive adhesive sheet 1 in a state in which it has been taken up in a cylindrical form. Thus, there is no need to prepare a large space for the stocking of the heat sensitive adhesive sheet 1, thereby making it possible to achieve a reduction in apparatus size. Further, due to the construction in which the heat sensitive adhesive sheet 1 is taken up on the take-up roller 10*a*, it is possible to provide a large stocking capacity with a small stocking space, so that the sheet length allowing stocking is less restricted.

The printer of the present invention is not restricted to the embodiment specifically described above, but allows various modifications without departing from the gist of the invention.

For example, while in the above-described embodiment a heat sensitive type printing device like a thermal printer is applied as the printing unit, the present invention is also applicable to printing devices of the thermal transfer system, the ink jet system, the laser printing system, etc. In this case, instead of the heat sensitive printing layer, a sheet material which has undergone a processing suitable for the printing system adopted is used as the printable layer of the sheet material.

Further, the mechanism for temporarily stocking a sheet-like recording material of the present invention, which is of the apparatus construction as shown in FIG. 1, is also applicable to a two-side printing type printer in which the thermal activation unit is replaced by a printing unit, or to a printer which is equipped with no thermal activation unit. In this case, instead of the heat sensitive adhesive sheet, there is used, for example, an ordinary paper sheet or a sheet material with a release sheet (liner) attached to the back side of the recording surface thereof.

What is claimed is:

1. A temporary stocking mechanism for temporarily stocking a sheet-like recording material prior to execution of a predetermined processing operation on the sheet-like recording material, the temporary stocking mechanism comprising: a take-up device having a take-up roller that takes up the sheet-like recording material to temporarily stock the sheet-like recording material, a plurality of guides that surround an outer peripheral surface of the take-up roller and that are movable in a radial direction of the take-up roller, and at least one elastic member that surrounds outer peripheral surface portions of all of the guides and that biases all of the guides toward the outer peripheral surface of the take-up roller.

2. A temporary stocking mechanism according to claim 1; further comprising conveying means for conveying the sheet-like recording material to selectively introduce the sheet-like recording material into the take-up device and extract the sheet-like recording material from the take-up device.

3. A temporary stocking mechanism according to claim 1; wherein the elastic member is wrapped in an annular fashion around the outer peripheral surface portion of each of the guides.

4. A temporary stocking mechanism according to claim 1; wherein the take-up device has an insertion inlet through which the sheet-like recording material is selectively introduced into and extracted from the take-up device; and wherein the guides surround the entire outer peripheral surface of the take-up roller except for a portion of the outer peripheral surface of the take-up roller in the vicinity of the insertion inlet.

5. A temporary stocking mechanism according to claim 1; wherein the at least one elastic member comprises a rubber band.

6. A temporary stocking mechanism according to claim 1; wherein the at least one elastic member comprises a pair of elastic members each surrounding the outer peripheral surface portions of all of the guides and biasing all of the guides toward the outer peripheral surface of the take-up roller.

7. A temporary stocking mechanism according to claim 6; wherein the each of the elastic members comprises a rubber band.

8. A temporary stocking mechanism according to claim 6; wherein the take-up device is generally cylindrical-shaped; and wherein the elastic members surround the outer peripheral surface portions of all of the guides at a positions proximate respective opposite ends of the cylindrical-shaped take-up device.

9. A printer comprising: a printing device that prints on one side of a sheet-like recording material; a conveying device that conveys the sheet-like recording material in a predetermined direction; a cutter device that is provided on an output side of the printing device and that cuts the sheet-like recording material in a predetermined length; and a stocking mechanism according to claim 1 that temporarily stocks the sheet-like recording material.

10. A printer according to claim 9; wherein the stocking mechanism further comprises a conveying device that conveys the sheet-like recording material to selectively introduce the sheet-like recording material into the take-up device and extracts the sheet-like recording material from the take-up device.

11. A printer comprising: a printing device that prints on one side of a sheet-like recording material; a first conveying device that conveys the sheet-like recording material in a predetermined direction; a cutter device that is provided on an output side of the printing device and that cuts the sheet-like recording material in a predetermined length; a stocking mechanism according to claim 1 that temporarily stocks the sheet-like recording material; and a thermal activation device provided on an output side of the stocking mechanism, the thermal activation device having a heating unit that heats a side of the sheet-like recording material and a second conveying device that conveys the sheet-like recording material in a predetermined direction.

12. A printer according to claim 11; wherein the stocking mechanism further comprises a third conveying device that conveys the sheet-like recording material into the take-up device and extracts the sheet-like recording material from the take-up device.

13. A printer according to claim 11; wherein the sheet-like recording material has a printable layer formed on one side thereof and a heat sensitive adhesive layer formed on the other side thereof; and wherein the thermal activation device heats the heat sensitive adhesive layer of the sheet-like recording material to activate the adhesive layer.

14. A printer comprising: a first printing device that prints on one side of a sheet-like recording material; a first conveying device that conveys the sheet-like recording material in a predetermined direction; a cutter device that is provided on an output side of the first printing device and that cuts the sheet-like recording material in a predetermined length; a stocking mechanism according to claim 1 that temporarily stocks the sheet-like recording material; and a second printing device provided on an output side of the stocking mechanism and having a second printing device that prints on the other side of the sheet-like recording material and a second conveying device that conveys the sheet-like recording material in a predetermined direction.

15. A printer according to claim 14; wherein the stocking mechanism further comprises a conveying device that conveys the sheet-like recording material to selectively introduce the sheet-like recording material into the take-up device and extract the sheet-like recording material from the take-up device.

16. A temporary stocking mechanism for temporarily stocking a sheet-like material, the temporary stocking mechanism comprising:

a take-up roller around which a sheet-like material is wound;

a plurality of guides surrounding an outer peripheral surface of the take-up roller to form an inlet through which the sheet-like material is inserted to wind the sheet-like material around the take-up roller and through which the sheet-like material is extracted to unwind the sheet-like material from the take-up roller, the plurality of guides being movable in a radial direction of the take-up roller when the sheet-like material is wound around and unwound from the take-up roller; and at least one elastic member surrounding an outer peripheral surface portion of each of the guides and biasing each of the guides toward the outer peripheral surface of the take-up roller.

17. A printer comprising:

a printing device that prints on one side of a sheet-like material;

a cutter device that cuts the sheet-like material in a predetermined length; and a stocking mechanism according to claim 16 for stocking the sheet-like material.

18. A printer according to claim 17; wherein the sheet-like material has a printable layer formed on the one side thereof and a heat sensitive adhesive layer formed on the other side thereof; and further comprising a thermal activation device that heats the heat sensitive adhesive layer of the sheet-like material to activate the adhesive layer.

* * * * *